United States Patent [19]

DeSisto

[11] 4,037,729

[45] July 26, 1977

[54] DISPLAY APPARATUS

[75] Inventor: Frank Alfred DeSisto, Yonkers, N.Y.

[73] Assignee: J. C. Penney Company, New York, N.Y.

[21] Appl. No.: 683,187

[22] Filed: May 4, 1976

[51] Int. Cl.[2] ..... A47B 9/00; A47F 5/10

[52] U.S. Cl. ..... 211/208; 108/107; 211/87; 211/123; 248/214

[58] Field of Search ..... 211/45, 46, 162, 86, 211/87, 103, 105.1, 189, 190, 186, 187, 206, 207, 208, 123, 107, 113, 117; 248/223, 224, 243, 251, 252, 254, 255, 256, 257, 253, 261, 262–265, 266–269, 214, 215; 312/183, 184; 108/106–109

[56] References Cited

U.S. PATENT DOCUMENTS

| | | | |
|---|---|---|---|
| 1,648,171 | 11/1927 | Foster | 248/262 |
| 2,665,869 | 1/1954 | Samuels | 211/87 X |
| 3,025,971 | 3/1962 | McLean | 211/208 X |
| 3,128,075 | 4/1964 | Stein | 248/265 |
| 3,269,553 | 8/1966 | Ruhnke | 211/105.1 |
| 3,288,308 | 11/1966 | Gingler | 211/123 |
| 3,325,131 | 6/1969 | Englander | 248/251 |
| 3,450,270 | 6/1969 | Brown | 211/187 X |

FOREIGN PATENT DOCUMENTS

| | | | |
|---|---|---|---|
| 808,621 | 7/1951 | Germany | 108/107 |
| 148,855 | 2/1955 | Sweden | 108/107 |

*Primary Examiner*—Roy D. Frazier
*Assistant Examiner*—Terrell P. Lewis
*Attorney, Agent, or Firm*—Pennie & Edmonds

[57] ABSTRACT

A display apparatus for supporting merchandise items detachably connected to at least a pair of vertically oriented and spaced apart supporting members having slots. Such apparatus includes a pair of end brackets, each having at least one projecting lug for detachable connection with the slots and having a pair of spaced apart openings. A first supporting bar connected to and between the brackets includes latching arrangements projecting from opposite end surfaces of the bar and each formed generally on the opposite side of a longitudinal axis of the bar from the other. The latch arrangement defines a notch and forms a forward tongue portion which is adapted to removably and transversely extend through respective ones of the openings. The notches are sized to enable vertical, longitudinal and tilting displacement of the bar relative to the bracket means for permitting the assembling and disassembling of such bar to the bracket. The longitudinal displacement defined by each notch means is dimensioned to enable it to accommodate, various spacings which may exist between the brackets mounted on the shelf supporting members and to limit undesired displacement of the bar. Each latch is at least of a length which enables a second supporting bar having latching arrangements to be inserted in or removed from the other of the openings in the brackets and be in an overlapping position with respect to the first supporting bar, without being obstructed by the latter.

5 Claims, 3 Drawing Figures

10
20
32
30
16
18
40
28
12
26
14
24
22
38

28
34
32
35
36

20
3
40
42
48
50
46
52
44
22
30
32

DISPLAY APPARATUS

FIELD OF THE INVENTION

This particular invention pertains to supporting apparatus. More specifically, it relates to a simple, versatile, novel and improved supporting apparatus for supporting and displaying merchandise and the like.

DESCRIPTION OF THE PRIOR ART

In the merchandising field, it is conventional to employ display apparatus which is adapted to support a wide variety of merchandise. Ordinarily, the supporting display apparatus is associated with a plurality of vertically extending and spaced apart slotted shelf supporting members and includes bracket members having mounting lugs which are removably connected to these upright slotted shelf support members. In a typical arrangement, a bracket is associated with each shelf supporting member. Removably fastened to and between the spaced bracket members is a generally elongated horizontal supporting bar member attached at its corresponding ends to the pair of appropriately spaced mounting brackets. By virtue of this particular relationship there is defined a rigid supporting structure. In the assembled condition of this structure the standard practice is to apply appropriate merchandise display support clips to the supporting bar. The application of the supporting clips are for purposes of displaying various types of merchandise items supported therefrom.

In general, however, conventional merchandise display apparatus are characterized by rather complicated and expensive arrangements often requiring numerous and relatively complicated components which effectively serve to interconnect the horizontal supporting bar to the end brackets and also secure the brackets to the suitable vertical shelf supporting members. One specific example of such a rather common form of structurally complicated construction is generally described in U.S. Pat. No., 2,031,718. As will be observed in this particular patent several somewhat complicated structural components are required to complete the entire supporting assembly.

With other known kinds of displaying apparatus, occasions arise wherein two or more of such displaying apparatus are mounted in side-by-side relationship on modular display units. To provide for an interconnection between these juxtaposed displaying apparatus one approach is to employ a plurality of clamping brackets which may include, for example, a generally U-shaped member having a pair of threaded members connected thereto for contact with ends of supporting bars. Essentially, such clamping brackets primarily serve to interconnect opposing juxtaposed horizontal supporting bars of each display apparatus in an end-to-end relationship. However, in ordinary practice, there are unnecessary expenses involved for effectuating the above type of connection since such clamping members have relatively complicated constructions in addition to the requirement that hand tools be used to fasten and unfasten respective ends of the supporting bars to these clamping brackets. Such a procedure wherein hand tools are employed, of course, tends to be time consuming and, therefore, somewhat expensive if it is considered that displays are relatively frequently changed. Another disadvantage encountered by such an approach is that the known interconnecting clamping brackets are unable to effectively compensate for any misalignment which might exist between adjacent shelf supporting members. It will be appreciated, therefore, that such noted typical forms of prior art arrangements of this latter category are unsatisfactory in terms of the cost involved since they are relatively complicated in construction and have numerous components as well as are relatively cumbersome to use particularly whenever assembled and disassembled.

From the foregoing considerations it is evident that heretofore known merchandise display apparatus, in general, suffer from the shortcomings of being complicated in construction and generally difficult to assemble and disassemble. Additionally, such prior art display apparatus are not particularly versatile whenever display units are to be placed together in a side-by-side relationship. Other disadvantages connected with the use of such conventional clamping brackets are the added costs attendant with their storage, manufacture and use.

Accordingly, in view of the foregoing remarks directed towards the several deficiencies associated with heretofore known merchandise display apparatus, it becomes an object of the instant invention to overcome such deficiencies by making provision for unique, reliable and simply constructed display apparatus which is particularly adapted for successfully supporting and displaying merchandise items by facilitating a versatile, advantageous and quick interconnection of juxtaposed horizontal supporting bars in an end-to-end relationship with a minimum of components.

SUMMARY OF THE INVENTION

Broadly, in accordance with the principles of this invention such envisions a display apparatus for merchandise or the like. Such display apparatus is detachably connected to at least a pair of vertically oriented and spaced apart shelf supporting members wherein each member has a plurality of discrete slots formed therein.

The display apparatus of this invention includes a pair of end bracket means, each of which has at least one projecting lug member for removable connection to respective ones of the slots in the shelf supporting members. Respective ones of the pair of end brackets means include a pair of discrete openings. Moreover, this display apparatus envisions an elongated horizontal supporting bar having latching means projecting from opposite end surfaces of the bar and being formed generally on opposite sides of a longitudinal axis of the bar from the other latching means and have notch means which form a forward tongue portion which is adapted to removably and transversely extend through respective ones of the openings. The notch means are sized to enable vertical, longitudinal and tilting displacement of the bar relative to the bracket means for permitting the assembling and disassembling of such bar to the bracket means. The horizontal displacement defined by the notch means is dimensioned to enable it to not only accommodate, in a versatile manner, with various spacings which may exist between the bracket means mounted on the shelf supporting members but also limit undesired displacement of the bar. Also, such latch means is at least of such a length which enables a second supporting bar having latching means to be inserted in or removed from the other of the openings in the bracket means and be in an overlapping position with respect to the first supporting bar without being obstructed by the latter.

BRIEF DESCRIPTION OF THE DRAWINGS

The above, as well as other objects, features, and advantages of the instant invention will become readily apparent after reading a detailed description thereof when viewed in conjunction with the accompanying drawings.

DETAILED DESCRIPTION

Figure 1:
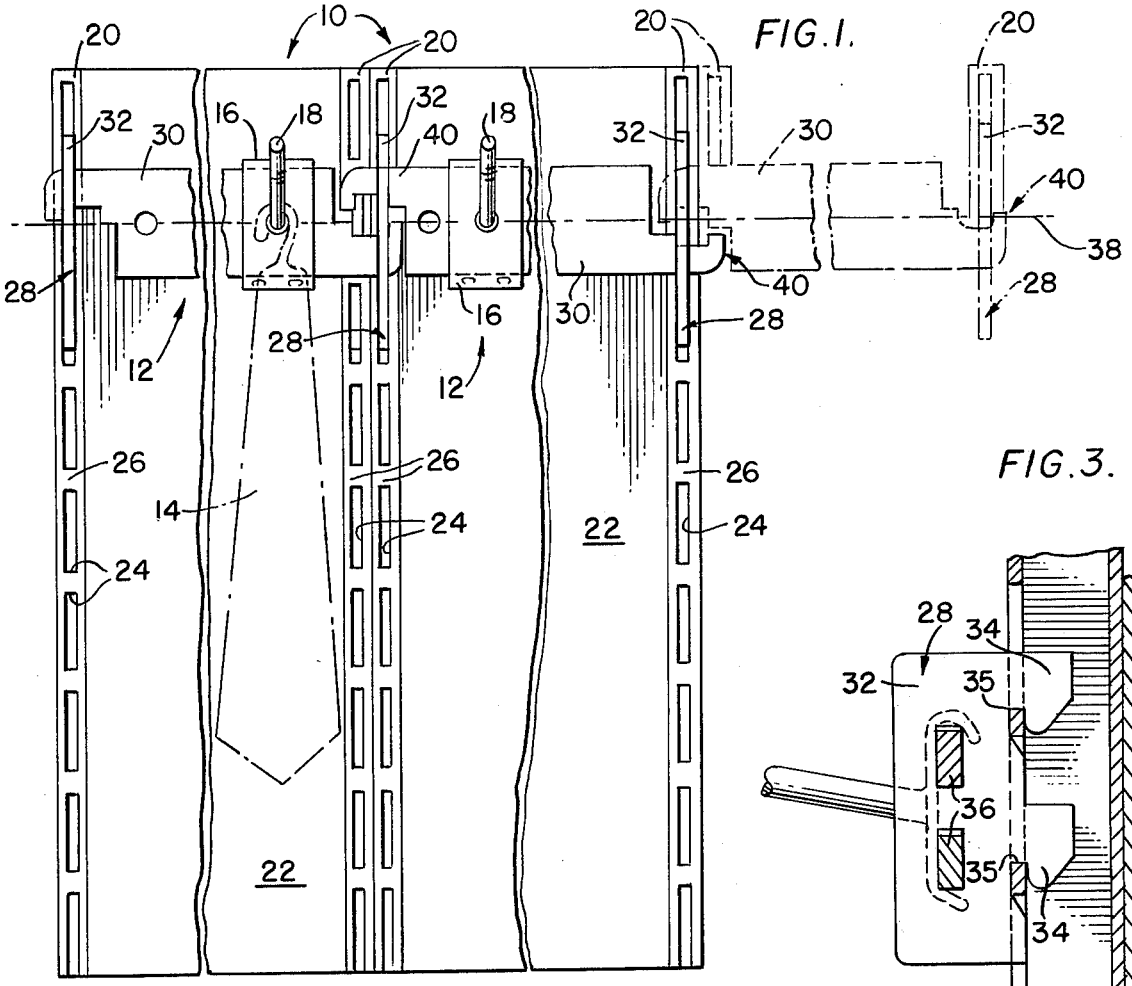
FIG. 1 is an elevational view illustrating several adjacent display apparatus units associated with displaying apparatus embodying the principles of this invention.

Referring now to the drawings, and, in particular, to FIG. 1 thereof, there is perhaps best illustrated a plurality of conventional displaying units generally indicated by reference numeral 10 and arranged in a side-by-side relationship. As will afterwards be more fully explained, display apparatus 12, embodying the principles of the present invention, are suitably secured to respective ones of the displaying units 10 for purposes of displaying merchandise items, such as ties 14 or the like, from known types of supporting clamp members 16 having, for example, projecting rods 18 upon which the items are supported.

As presently depicted in FIG. 1, each of the conventional displaying units 10 usually includes at least a pair of conventional vertically oriented, generally parallel, and spaced apart shelf supporting members 20. The shelf supporting members or fixtures 20 of the illustrated embodiment are of the wall type and may be suitably connected to an appropriate stationary supporting surface 22. As is rather conventional, such vertically disposed wall shelf supporting members 20 may be formed from a hollow channel construction having a multiplicity of discrete vertically spaced apart openings 24 separated by horizontal bracket supporting webs 26. Such openings 24 and webs 26 cooperate with and support the display apparatus 12, in a manner which will subsequently be made clear. While the present embodiment is directed to wall shelving support members 20, such invention envisions that displaying apparatus 12 can also be easily used in conjunction with known types of floor modular display fixtures which likewise include a plurality of discrete openings similar to openings 24. It should be mentioned that in actual practice the spacings between the centerlines for the respective shelf supporting members 20 are usually of a predetermined distance. With, however, certain types of fixtures a slight variance from such standard spacing may be encountered. For purposes of better illustrating the present invention it will be understood that in the embodiment of FIG. 1 the centerline spacing between the leftmost pair of shelf supporting members 20 is the same as the spacing between the rightmost pair of shelf supporting members 20 indicated in solid lines. In addition, the spacing between the rightmost pair of supporting members 20 indicated in broken lines is somewhat longer than the spacing between the rightmost pair of shelf members indicated in solid lines. By way of specific illustration and not, of course, limitation, the spacing between the centerlines of the pairs ofsupporting shelf members 20 indicated in solid lines, could be 29½ inches, and the spacing between the shelf supporting members 20 of the other respective pair, indicated in broken lines, could be 30 inches. It should be pointed out that other distances are permitted within the broad ambit of this invention.

Figure 3:
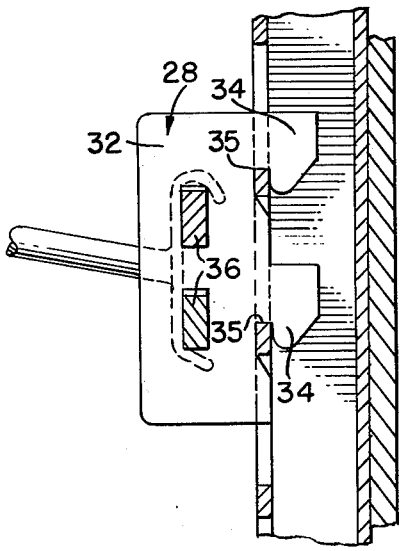
Figure 2:
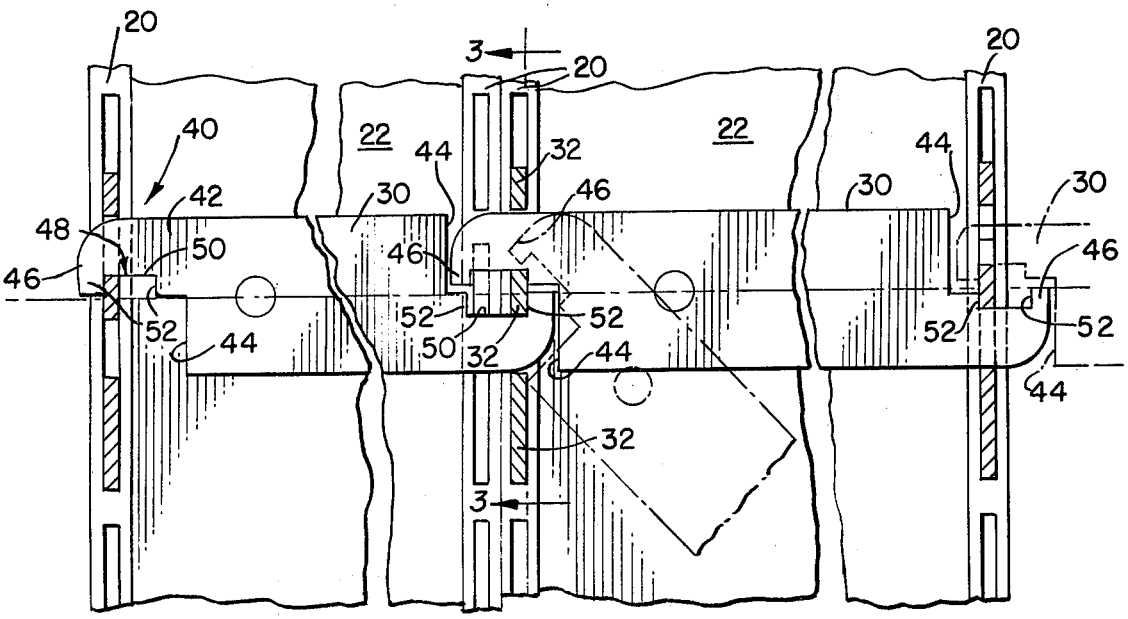
FIG. 2 is an enlarged elevational view similar to FIG. 1 illustrating, in somewhat greater detail, the components of the present invention; and, FIG. 3 is a view partly in section taken substantially along section line 3—3 in FIG. 2 looking in the direction of the arrows and illustrating even more details of the novel and improved features of the instant invention.

Displaying apparatus 12 of this particular invention includes a pair of similar end bracket means 28 and a generally elongated supporting bar member 30 having its ends detachably connected to and between respective ones of the end bracket means 28, such as clearly shown in FIGS. 1 and 2. Each end support bracket means 28, as clearly shown in FIG. 3, is adapted to cooperate with the openings 24 and webs 26 formed in the shelf supporting members 20. In this particular fashion, the bar member 30, in a manner to be described, can be securely anchored to the supporting surface 22 for purposes of supporting merchandise items 14. With continued reference to the pair of end bracket means 28, a description of only one will follow, inasmuch as both are substantially identical in construction.

Still referring to FIG. 3 taken in conjunction with FIG. 2, one of the end bracket support means 28 is defined by a generally flat bracket plate member 32 having, for example, a generally rectangular configuration. Such plate member 32 may be fabricated from any suitable rigid type material capable of withstanding heavy loads. As is believed readily apparent by having the particular configuration of a thin plate, bracket member 32 provides for an extremely simple construction which lends itself to economical manufacture and easy use. Moreover, by virtue of such construction bracket plate member 32 serves to enable and enhance the insertion in and removal of the supporting bar 30 for facilitating assembly and disassembly of the display apparatus 12. Preferably, but not necessarily, a pair of lug members 34 project laterally outwardly from the bracket plate member 32. Associated inwardly of each lug member 34 is an angular indentation 35 which is adapted to cooperate with lateral web portions 26 in conventional fashion. Accordingly, it will be understood, that such bracket member 32 is removably secured to the openings 24 by the lug members 34. It will also be recognized, of course, that end bracket plate member 32 can be selectively vertically positioned by removal and reinsertion of the lug members 34 in other suitable pairs of openings 24.

Additionally, end bracket plate members 32 may also be formed with a pair of discrete vertically spaced openings 36. Essentially, each of openings 36 is adapted to cooperate with a respective end of supporting bar 30 to correspondingly define a display support structure capable of supporting and facilitating the display of merchandise items 14. More specifically, as will become evident, the present invention envisions that a single bracket plate member 32 will be utilized for purposes of supporting a plurality of supporting bars 30 held, for example, in end-to-end relationship such as more clearly depicted in FIGS. 1 and 2.

Although the preceding deescription has, in general, described a particular configuration for the single bracket member 32, the foregoing bracket member can have a wide variety of other forms of configurations and yet remain within the spirit and scope of this invention for reasons afterwards made clear. Also, while two discrete openings 36 are depicted as being formed in the bracket member 32, it will be appreciated that other suitable numbers may be provided.

As concerns the supporting bar member 30, reference is again made to both FIGS. 1 and 2. It is within the theory and practice of this particular invention that such supporting bar 30 may adopt a wide variety of configurations so long as consistent with the scope of this invention. However, as presently described, such bar 30 is defined by a generally elongated flat member having a longitudinal axis 38. Formed at each end of the bar member 30 are latching means 40. As generally illustrated, each latching means 40 is defined by a latching finger 42 which projects from opposite end surfaces 44 of the bar member 30. Also, as shown, each of the latching fingers 42 is formed on opposite sides of a central plane which is transverse to the drawing and passes through and along the longitudinal axis 38. Thus, the latching means 40 are generally symmetrically situated with respect to each other about the axis 38. The particular significance of such relationship will be subsequently set forth in the succeeding description. The latching finger 42 of the latching means 40 defines a forwardly rounded tongue portion 46. The tongue portion 46 is adapted to removably and transversely extend through the vertical plane formed by respective ones of the discrete openings 36. Accordingly, the latching means 40 may engage and be supported by the brackets 32. In one embodiment the tongue portion 46 may have a cross-sectional height which exceeds the height of the opening 36 for reasons which restrict undesired displacement of supporting bar 30. Moreover, the cross-sectional height of the tongue portion 46 could be less than the height of the openings 36 for enabling it to better rest upon and be supported by the bracket member. Alternatively, of course, the sizes of the openings 36 can be appropriately selected for achieving the foregoing results.

Notch means 48 of the preferred embodiment are provided for each of the latching fingers 42. As best viewed in FIG. 2, the notch means 48 may be suitably situated intermediate the longitudinal extent of the latching finger 42. Each notch means 48 faces the longitudinal axis 38 and in the opposite direction from the other. The notch means 48 are formed by rectangular notches or cutouts 50 which are sized to permit vertical, longitudinal and tilting displacement of the bar 30 relative to each end bracket member 32. In this manner, as will be made clear, the supporting bar 30 can be easily and conveniently inserted in and removed from the openings 36.

The notch 50 may have a longitudinal extent which permits the bar member 30 to slide relative to the end bracket member 32 and which enables it to cooperate not only with bracket members associated with a pair of shelf members 20 forming one display unit 10 but also a bracket member associated with a second pair of shelf members 20 spaced beyond the first pair of shelf members 20. An example of this feature is clearly illustrated in FIGS. 1 and 2, wherein adjacent ends of the supporting bars 30 cooperate with single bracket members 32. Accordingly, a single and simply constructed bracket member 32 can be effectively utilized for supporting opposite ends of two discrete supporting bar members 30 as opposed to the conventional and complicated clamping components which in many instances require the application of suitable hand tools. Moreover, each notch 50 has a depth which is sized to permit ample vertical displacement of the bar 30 relative to the bracket members 32. It will be recognized that the notches 50 thus formed facilitate compensation for slight misalignment which may otherwise occur between misaligned side-by-side shelf supporting members 20. Also, of course, the size of openings 24 may be appropriately varied for facilitating the foregoing. Stop surfaces 52 are formed at the ends of the individual notches 50 and are adapted to engage the corresponding side surfaces of the brackets 32 for limiting the noted longitudinal movement thereof. Additionally, the axial extent of notch 50 can be larger than that which is shown. For instance, the notch could extend from the tongue portion to the bar end surface. However, for a relatively more stable apparatus, it has been determined that a relative short axial extent for notch 50 should be provided in order to limit undesired longitudinal displacement of the bar 30 whenever in the assembled condition. As previously observed in FIGS. 1 and 2, the notch 50 is formed intermediate the length of such latch finger 42. It will further noted that the inward stop surface 52 is spaced from the end surface 44 by at least a distance which permits the other latch means on the other similar supporting bars to be in an overlapping relationship with the first supporting bar 30, much as in the manner shown in FIG. 2. Also end surface 44 and the stop surface may be a continuous surface.

It is to be understood that the stop surfaces 52 may be arranged such that whenever in the assembled condition they may or may not contact the sides of the bracket members 32. It is also understood that the maximum spacing of shelf members 20 is determined by the stop surfaces formed adjacent the tongue portions 46.

In this particular embodiment whenever bar 30 is in the process of being assembled, the latch fingers 42 may be tiltably displaced such as shown by the dotted lines in FIG. 2 whereby the tongue portion 46 easily passes through openings 36 so as to be inserted in and engage with the same mounting bracket 32 without being obstructed by a supporting bar 30. As a consequence thereof, significant versatility is added to the display apparatus 12 whenever mounting juxtaposed supporting bar members 30.

As shown in FIG. 1 the bracket member 32 associated with one middle supporting bar 30 has its innermost stop surfaces 52 abutting with rightmost bracket member 32 illustrated in solid lines, whereas, the outermost stop surfaces 52 are spaced from the middle, solid lines, bracket 32. Concerning the leftmost supporting bar 30 it will be seen to have both the outermost stop surfaces 52 containing the sides of corresponding bracket members since the middle bracket member 32, in solid lines, is associated with the middle pair of shelf supporting members 20. Accordingly, the distance between brackets is greater. It will be further observed that the supporting bar 30 shown in broken lines has its stop surfaces 52 engage with the sides of the corresponding brackets 32. Such arrangement results, of course, from the spacing between the centerlines for the shelf members 20 shown in dotted lines being larger than the spacing between the adjacent pairs of shelf supporting members 20. It is apparent, therefore, that the supporting bars 30 can be arranged to accommodate a wide variety of spacings between shelf members without the necessity of numerous components.

Accordingly, the foregoing construction of this invention permits a display apparatus 12 to be constructed, wherein the bar members 30 associated with separate display units 10 can be situated in an end-to-end and generally linearly aligned relationship, such as clearly depicted in FIG. 2. Moreover, such arrangement somewhat accommodates for situations wherein adjacent shelf supporting members 20 of display units 10 are somewhat misaligned. Importantly, it is emphasized that the foregoing described arrangement provides a minimum number of mounting components yet achieves in a simple and reliable fashion a versatile display support. Additionally, significant savings in labor time results since there is no requirement for hand tools to assist in the assembly and disassembly of the structure. Consequently, there is achieved an extremely simple, reliable and economical display support apparatus which advantageously lends itself to being used as a support structure for displaying merchandise, particularly where adjacent modular supporting display units are employed for displaying merchandise.

While the invention has been described in connection with the preferred embodiment, it is not intended to limit the invention to the particular form set forth above, but on the contrary, it is intended to cover such alternatives, modifications and equivalents as may be included within the spirit and scope of the invention as defined by the appended claims.

What is claimed is:

1. Display apparatus for supporting merchandise items which is detachably connected to at least a pair of vertically oriented and spaced apart shelf supporting members having a plurality of discrete slots formed therein, including a pair of end bracket means, each one having at least one projecting lug for detachable connection with the slots and having a pair of spaced apart openings; and first supporting bar connected to and between the bracket means includes latching means projecting from opposite end surfaces of the bar, each latching means is formed generally on the opposite side of a longitudinal axis of the bar from the other latching means and has notch means and forms a forward tongue portion which is adapted to removably and transversely extend through respective ones of the openings, the notch means are sized to enable vertical, longitudinal and tilting displacement of the bar relative to the bracket means for permitting the assembling and disassembling of the bar to the bracket means, the longitudinal displacement defined by the notch means is dimensioned to enable it to not only accommodate various spacings which may exist between the bracket means mounted on the shelf supporting members, but also to limit undesired displacement of the bar by virtue of the notch means being selectively engageable with opposite sides of mounted bracket means, the latch means is at least of such a length which enables a second supporting bar having latching means to be inserted in or removed from the other of the openings in the bracket means and be in an overlapping position with respect to the first supporting bar without being obstructed by the latter.

2. The apparatus as set forth in claim 1 in which said end bracket means is defined by a flat plate bracket member, and said latching means is comprised of an elongated latching finger which defines the tongue portion that is insertable through said openings.

3. The apparatus as set forth in claim 2 in which the notch means is comprised of an elongated notch formed intermediate the longitudinal extent of the latching finger and which defines opposite stop shoulder surfaces engageable with opposite sides of the plate member to positively limit the extent of longitudinal movement of the supporting bar.

4. Display apparatus for supporting merchandise items which is detachably connected to at least a pair of vertically oriented and spaced apart shelf supporting members having a plurality of discrete slots formed therein, including a pair of end bracket means each defined by a flat plate bracket member having projecting lugs for detachable connection with the slots and having a pair of spaced apart openings, and first supporting bar connected to and between the bracket means includes latching means projecting from opposite end surfaces of the bar, each latching means is comprised of an elongated latching finger which defines the tongue formed generally on the opposite side of a longitudinal axis of the bar from the other latching means and has notch means which forms a forward tongue portion which is adapted to removably and transversely extend through respective ones of the openings, the notch means being defined by an elongated notch formed intermediate the longitudinal extent of the latching finger and defines opposite stop shoulder surfaces selectively engageable with opposite sides of the plate member to positively limit the extent of longitudinal movement of the supporting bar, each notch is sized to enable vertical, longitudinal and tilting displacement of the bar relative to the bracket member for permitting the assembling and disassembling of the bar to the bracket member, the longitudinal displacement defined by each notch is dimensioned to enable it to not only accommodate various spacings which may exist between the bracket members mounted on the shelf supporting members, but also to limit undesired displacement of the bar by virtue of the stop surfaces being engageable with opposite sides of mounted bracket members, the latching finger is at least of such a length which enables a second supporting bar having latching means to be inserted in or removed from the other of the openings in the bracket member and be in an overlapping position with respect to the first supporting bar without being obstructed by the latter.

5. Display apparatus for supporting merchandise items being detachably connected to vertically oriented and spaced apart shelf supporting members having a plurality of discrete slots formed therein and being arranged such that a plurality of first and second pairs of discrete columns of slots are formed, said apparatus including bracket means being defined by first, second and third flat plate members and having projecting lugs for detachable connection with the slots, and each plate member having a pair of spaced apart openings, the first plate member being connected to one column of slots in a first pair of columns of slots, the second plate member being connected to the other column of slots in the first pair of columns of slots, and the third plate member being connected to the column of slots in the second pair of slots which is remote from the second plate member; and first and second supporting bars connected respectively, to and between the first and second and second and third bracket plates including latching means projecting from opposite end surfaces of the first and second bars, each pair of latching means is formed generally on the opposite sides of a longitudinal axis of each bar and has notch means and form forward tongue portions which are adapted to removably and transversely extend through respective ones of the openings, the latching means on the first bar connected to one of the openings in the second bracket member, the latching means of the second bar being inserted in or removed from the other opening in the second bracket member and in an overlapping position with respect to the first supporting bar without being obstructed by the latter, the notch means being sized to enable vertical, longitudinal and tilting displacement of the bar relative to the bracket members for permitting the assembling and disassembling of the bars to the bracket members, the longitudinal displacement defined by the notch means enables the respective first and second bars to not only accommodate the spacings which may exist between their respective pairs of slots but also with closely situated brackets of the other pair of slots, the stop surfaces of the notches also limit undesired longitudinal displacement of the bars by virtue of the stop surfaces being engageable with opposite sides of bracket members.

* * * * *